US005383731A

United States Patent [19]

Hattori et al.

[11] Patent Number: 5,383,731

[45] Date of Patent: Jan. 24, 1995

[54] PRINTING DEVICE HAVING A PRINT MEDIA DETECTOR

[75] Inventors: Shigenori Hattori, Ama; Kazuko Ishida, Konan; Miyuki Narukawa, Kasugai, all of Japan

[73] Assignee: Brother Kogyo Kabushiki Kaisha, Nagoya, Japan

[21] Appl. No.: 64,716

[22] Filed: May 20, 1993

[30] Foreign Application Priority Data

Jun. 5, 1992 [JP] Japan ..... 4-145725

[51] Int. Cl.[6] ..... B41J 7/96

[52] U.S. Cl. ..... 400/76; 400/708

[58] Field of Search ..... 400/120, 208, 586, 708, 400/249, 219, 219.1, 76

[56] References Cited

U.S. PATENT DOCUMENTS 4,395,144 7/1983 Adams et al. ..... 400/124
4,568,951 2/1986 Hasegawa et al. ..... 400/323.1
4,839,742 6/1989 Nakatani et al. .
4,921,363 5/1990 Nishihara et al. ..... 400/208
5,183,333 2/1993 Minowa ..... 400/120
5,253,334 10/1993 Kimura et al. ..... 400/586
5,294,202 3/1994 Sawada et al. ..... 400/103

FOREIGN PATENT DOCUMENTS 0451830 10/1991 European Pat. Off. .
0497352 8/1992 European Pat. Off. .
0512168 11/1992 European Pat. Off. .
3-68443 7/1991 Japan .

*Primary Examiner*—Edgar S. Burr
*Assistant Examiner*—John S. Hilten
*Attorney, Agent, or Firm*—Oliff & Berridge

[57] ABSTRACT

A first tape cassette or a second tape cassette is assembled in a tape cassette holding portion of a printing device, and a print key is operated. If a normal character image print mode is set based on a value of a print mode flag, the normal character image is printed on a printing tape. If a reflected character image print mode is set, a reflected character image is printed on the printing tape. Moreover, when a third tape cassette is assembled in the tape cassette holding portion of the printing device, the set print mode is disregarded, and the reflected character image is only printed on a base tape.

26 Claims, 8 Drawing Sheets

PRINTING DEVICE HAVING A PRINT MEDIA DETECTOR

BACKGROUND OF THE INVENTION

1. Field of the Invention

The present invention relates to a printing device for printing an image on a tape-like member.

2. Description of Related Art

Conventionally, printing devices have a print mode change means for changing a normal character image print mode for printing a normal character image to a reflected character image print mode for printing a reflected character image on a printing medium. An operator can print the normal character image or the reflected character image on the printing medium by operating the print mode change means. U.S. Pat. No. 4,839,742 discloses such a printing device.

Another known printing device has a first cassette and a second cassette that can be selectively mounted therein. The first cassette stores a print tape, which has a printing surface and an opposed sticky layer with a releasable paper, and an ink ribbon. The second cassette stores a print tape formed by a transparent film, a dual sided adhesive tape having a releasable paper on one surface reverse to its printing surface, and an ink ribbon. The cassette that is mounted on the printing device is detected, and the print mode can be automatically changed according to the detected cassette. Such a printing device is disclosed in Japanese Utility Model Laid-Open No. 3-68443. In a printing device thus constructed, when the first cassette is detected, a normal character image print mode is automatically set. Then, a normal character image is printed on the printing surface of the print tape through the ink ribbon. When the second cassette is detected, a reflected character image print mode is automatically set. Then, a reflected character image is printed on the printing surface of the print tape through the ink ribbon, and the printed surface of the print tape is adhered to a surface of the dual-sided adhesive tape where the releasable paper is not affixed.

In such a printing device, there is also a third cassette for making an instant lettering tape that stores a base tape for instant lettering and an ink ribbon. A fourth cassette makes an iron print tape that stores a base tape for an iron print and an ink ribbon.

The instant lettering tape is made by printing characters with the reflected character image on the base tape for the instant lettering through the ink ribbon. The characters printed on the base tape are transferred to an image transferred material by causing the printed side of the instant lettering tape and the receiving material to confront and rubbing the non-printed side of the instant lettering tape.

The iron print tape is made by printing characters with the reflected character image on the base tape for the iron printing through the ink ribbon. The characters printed on the base tape are transferred to an image transferred cloth, such as a handkerchief, by causing the printed side of the iron print tape and the receiving material to confront. The iron print tape is then heated and pressed on the non-printed side with an iron.

If the dual-sided adhesive tape stored in the second cassette is constructed with a transparent film, the characters, such as a brand name, are printed with the normal character image on the print tape. Then, the print tape and the dual-sided adhesive tape are adhered, and the releasable paper is peeled therefrom. The adhesive tape is then affixed on the inside of the window glass. Therefore, the characters of the normal character image can be shown from the outside of the window. To make such a print tape, it is possible to provide the print mode change means for changing the print mode to a normal character image from a reflected character image and vice versa.

When the third and the fourth cassettes are set in the above printing device, the print mode is automatically set as the reflected character image print mode. However, if the print mode change means is operated changing the print mode from the reflected character image print mode to the normal character image print mode, a normal character image will be printed on the base tape for the instant lettering and the base tape for the iron print. When the normal character image printed on the instant lettering tape and the iron print tape is transferred to the image transferred material, the transferred image becomes a reflected character image. Thus, the image cannot be recognized as a normal character image.

SUMMARY OF THE INVENTION

It is therefore an object of the present invention to overcome the above described drawbacks. A primary object is to provide an improved printing device capable of printing images on a tape-like member with an appropriate print mode according to the kind of tape-like member set in the printing device. Thus, printing an inappropriate print mode on the tape-like member is prevented.

This and other objects of the invention are achieved by providing a printing device for printing images, such as characters and symbols, on a first or second image receiving member that is selectively set in the printing device. The print device comprises (a) a print mode set means for setting a normal character image print mode for printing an image on an image receiving medium as a normal character image or a reflected character image print mode for printing an image as a reflected character image; (b) a detect means for detecting whether the image receiving medium set in the printing device is the first image receiving medium or the second image receiving medium; and (c) a control means for printing the normal character image or the reflected character image on the first image receiving medium according to the print mode set by the print mode set means when the image receiving medium set in the printing device is detected to be the first image receiving medium by the detect means. The control means also sets the normal character image print mode or the reflected character image print mode when the image receiving medium set in the printing device is detected to be the second image receiving medium by the detect means and prevents the print mode change means from changing the print mode.

In the printing device thus constructed, if the detect means detects that the first image receiving means is set in the printing device, the control means controls the print means for printing the normal character image or the reflected character image on the first image receiving medium according to the print mode set by the print mode set means. If the detect means detects that the second image receiving medium is set in the printing device, the control means sets the normal character image print mode or the reflected character image print mode. The control means also controls the print means for printing the normal character image or the reflected character image on the second image receiving medium according to the set print mode. Moreover, the control means disregards a change of the print mode by the print mode change means.

Thus, according to the invention, it is possible to print an image with an appropriate print mode according to the kind of image receiving medium set in the printing device. The print device therefore does not create a wasteful image receiving medium printed with an inappropriate print mode.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

A printing device according to the present invention is described with reference to FIG. 1 through FIG. 10.

Figure 2:
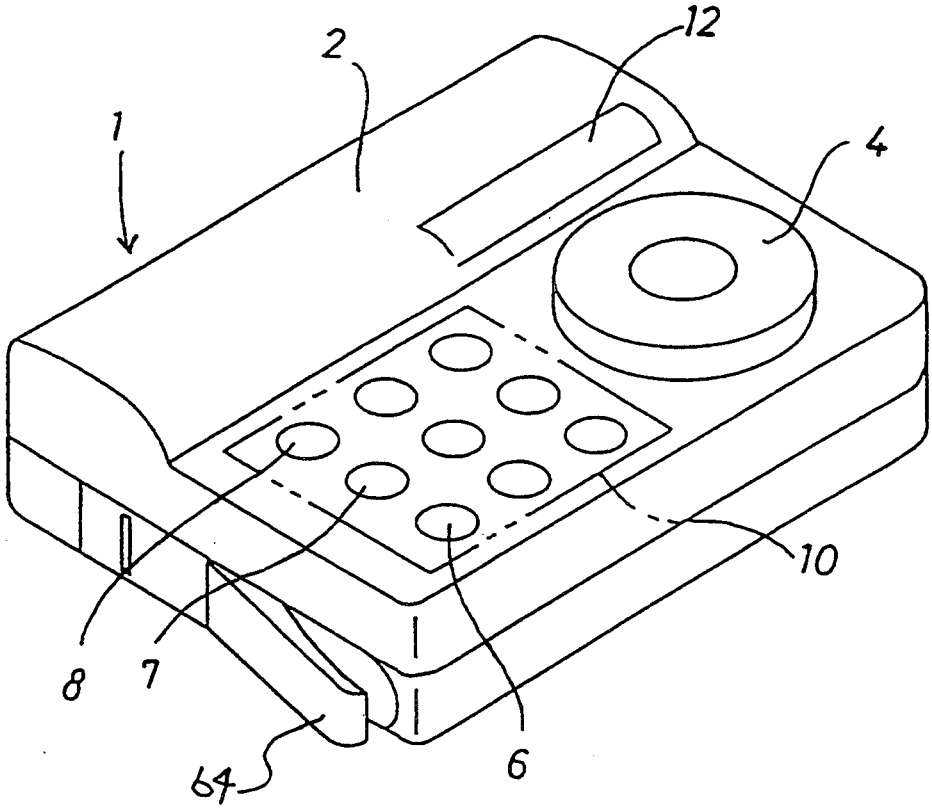
FIG. 2 is a perspective view showing a front side of the printing device.

FIG. 2 is a perspective view of a printing device 1. A character selection dial 4 that can be movably operated is provided on a main body 2 of the printing device 1. Provided in the vicinity of the character selection dial 4 are a plurality of function keys 10 for performing various controls of the printing device 1, such as a power supply switch 6, a print mode change key 7, and a print key 8. A liquid crystal display 12 (hereinafter, called "LCD") for displaying input characters and symbols is further provided on the main body 2.

Figure 3:
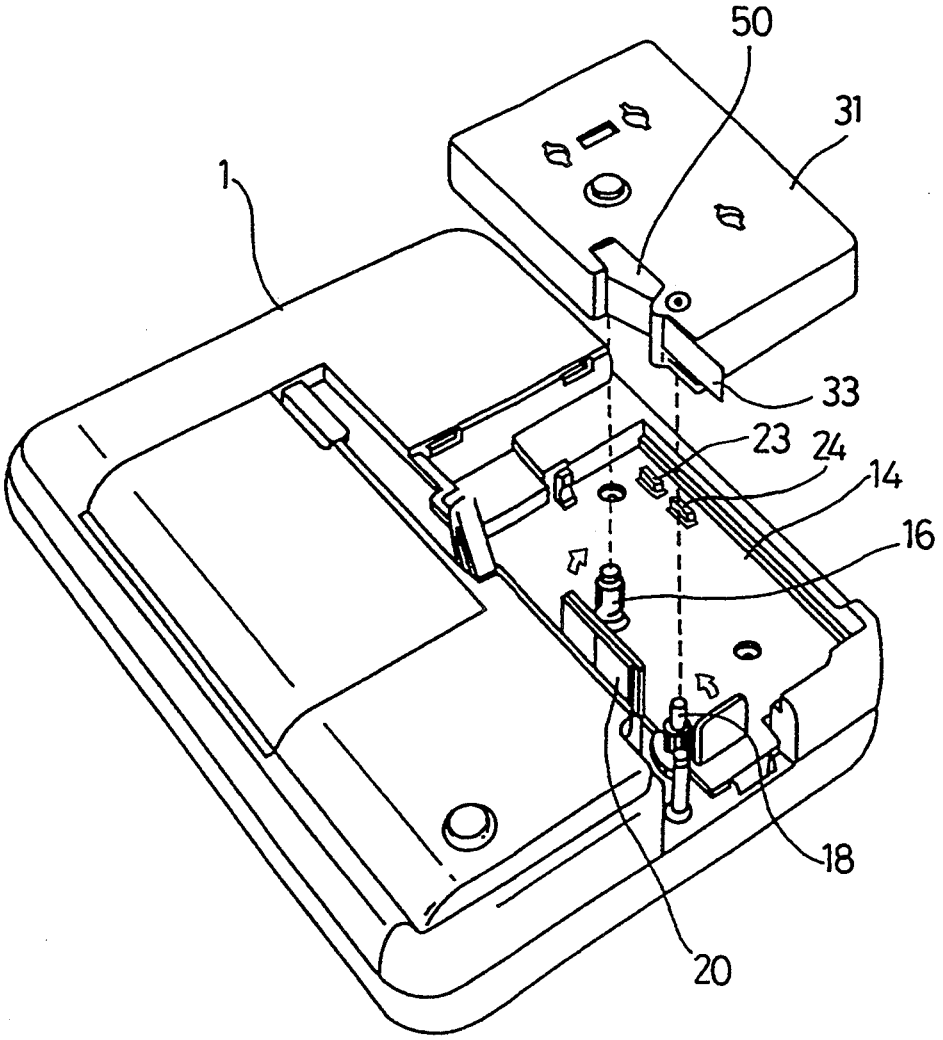
FIG. 3 is a partly exploded perspective view showing a rear side of the printing device of FIG. 2 and its tape cassette.

In a rear side of the printing device 1 shown in FIG. 3, a tape cassette holding portion 14 is provided for holding a first tape cassette 31, a second tape cassette 61 or a third tape cassette 71. The tape cassette holding portion 14 has a ribbon take-up cam 16 and a tape feed roller cam 18 therein. These cams 16 and 18 are drivingly coupled to a drive motor 89 (shown in FIG. 1) housed within an outer frame of the printing device 1 and are rotatable in the directions indicated by the arrows in FIG. 3.

Figure 4:
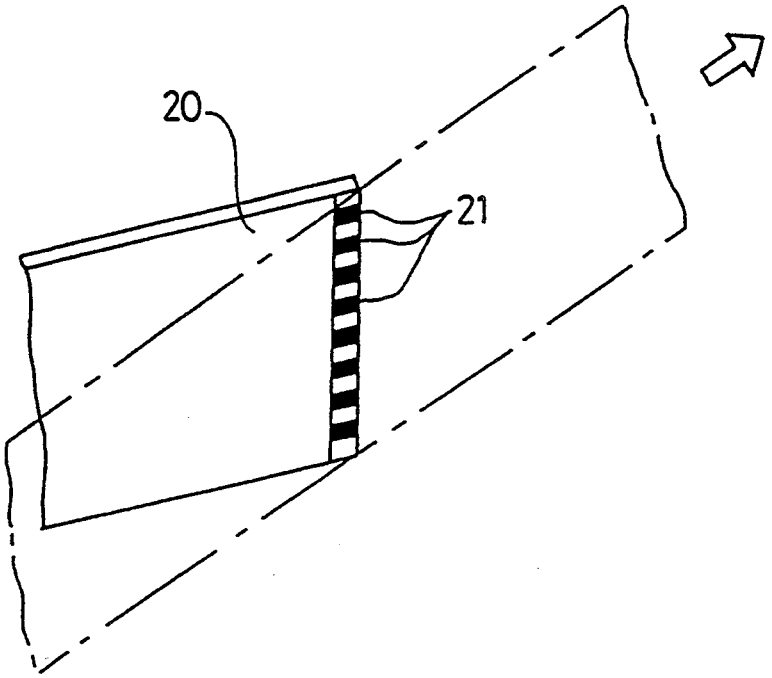
FIG. 4 is a perspective view of a thermal head for this invention.

The tape cassette holding portion 14 is also provided with a thermal head 20. The thermal head 20 is adapted to confront an opening portion 50 of the tape cassettes 31, 61 and 71 when they are inserted in the tape cassette holding portion 14. The thermal head 20 has an array of heat generating elements 21, the array being directed perpendicular to a feeding direction of the printing tape as best shown in FIG. 4. A print means of the present invention is constructed by the thermal head 20.

The tape cassette holding portion 14 is further provided with a first operation projection 23 and a second operation projection 24 movable in a vertical direction. The first and second operation projections 23 and 24 are normally biased toward the rear wall of the outer frame (upwardly in FIG. 3). However, when the first and second operation projections 23 and 24 are urged to be depressed into an interior of the frame, the projections 23 and 24 actuate a first detector 91 and a second detector 92 in the printing device 1 connected to a control means described later with reference to FIG. 1. A detection means of the present invention is constructed by the first and second operation projections 23 and 24 and the first and second detectors 91 and 92.

Figure 5:
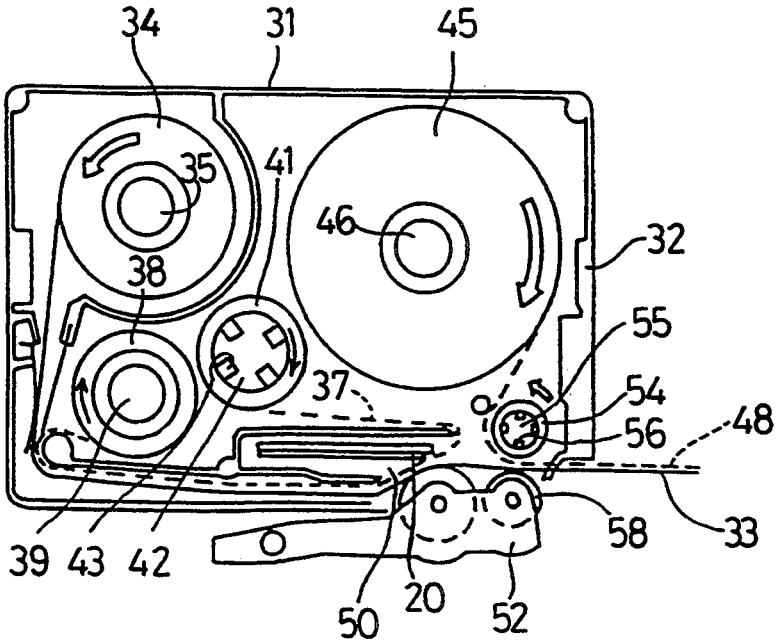
FIG. 5 is a plan view showing an internal arrangement of a first tape cassette according to this invention.
Figure 6:
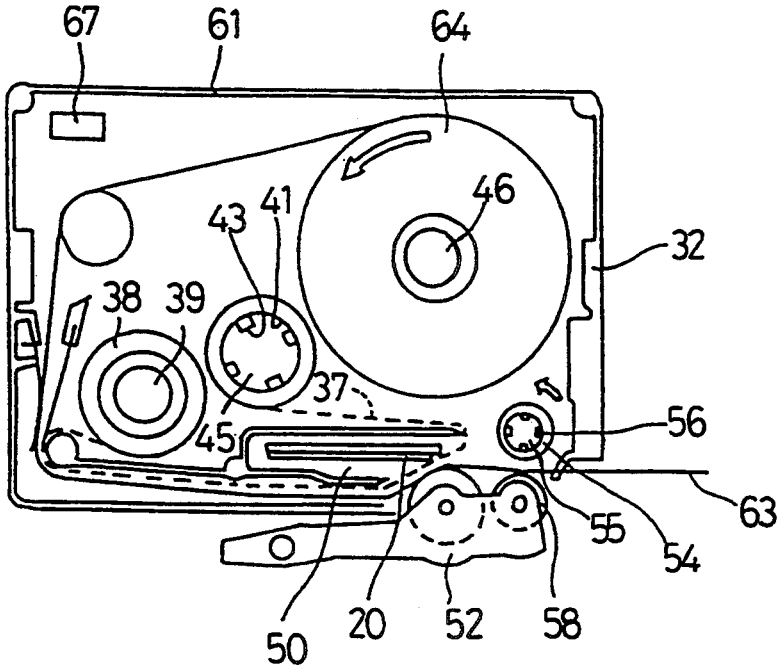
FIG. 6 is a plan view showing an internal arrangement of a second tape cassette according to this invention.
Figure 7:
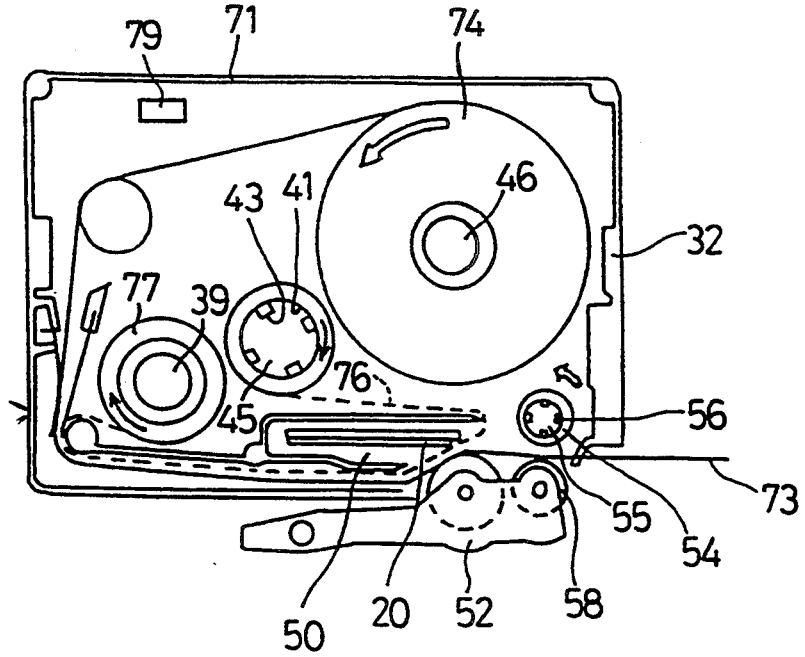
FIG. 7 is a plan view showing an internal arrangement of a third tape cassette according to this invention.

Different kinds of tape cassettes are useable with the tape printing device 1, as shown in FIGS. 5, 6, and 7. Referring first to the first tape cassette 31 shown in FIGS. 3 and 5, the first tape cassette 31 has a cassette case 32 with a rotation shaft 35 provided in the left upper side thereof. A tape spool 34 of a printing tape 33 is rotatably wound around the rotation shaft 35. The printing tape 33 is formed of a long transparent film-like material. Therefore, even if a reflected character image is printed on one printing surface of the transparent printing tape 33, the printed image is visible as a normal image when viewed from the opposite surface. A first image receiving medium of the present invention is constructed by the printing tape 33.

At the lower side of the tape spool 34, there are an ink ribbon 37, whose one surface is coated with an ink, and a take-up spool 41 to which a leading end of the ink ribbon 37 is fixed. The ink ribbon spool 38 is wound around a ribbon spool shaft 39, which is rotatably supported by the cassette case 32.

The take-up spool 41 has an inner peripheral surface with engaging protrusions 43 protruding radially inward. The take-up spool 41 is rotatably supported by a hollow sleeve 42 formed in the cassette case 32. The ink ribbon take-up spool 41 is engageable with the ink ribbon take-up cam 16 when the first tape cassette 31 is assembled into the tape cassette holding portion 14.

In the right side of the cassette case 32, another rotatable shaft 46 is rotatably provided. A spool 45 with a dual sided adhesive tape 48 is wound around the rotation shaft 46. The dual sided adhesive tape 48 has both front and rear surfaces formed with an adhesive agent, and a releasable paper is adhered to one adhesive surface thereof. The dual sided adhesive tape 48 is wound around the rotation shaft 46 with the releasable paper 47 facing outwardly.

An opening portion 50 is formed at the bottom center of the cassette case 32, as shown in FIG. 5. The printing surface of the printing tape 33 and the surface of the ink ribbon 37 with ink coated thereon are superposed and guided to the opening portion 50. Upon assembly of the tape cassette 31 into the tape cassette holding portion 14, the printing tape 33 is depressed onto the thermal head 20 through the ink ribbon 37 by a pressure contact-/release member 52. At this time, the printing surface of the printing tape 33 confronts the thermal head 20.

At the right side of the opening portion 50, a tape feed roller 54 is rotatably supported by a hollow sleeve 55 formed in the cassette case 32. The tape feed roller 54 has an inner peripheral surface with engaging protrusions 56 protruding radially inward. The tape feed roller cam 18 is inserted into the tape feed roller 54, and the engaging protrusions 56 engage with the cam 18 when the first tape cassette 31 is assembled into the tape cassette holding portion 14.

Upon assembly of the first tape cassette 31 into the tape cassette holding portion 14, a rotatable roller 58 supported by the pressure contact/release member 52 confronts the tape feed roller 54. The printing tape 33 and the dual sided adhesive tape 48 are guided between the tape feed roller 54 and the rotatable roller 58 with the printing surface of the printing tape 33 and the releasable paper 47 of the dual sided adhesive tape 48 confronting. The printing tape 33 and the dual sided adhesive tape 48 are adhered by both rollers 54 and 58.

When the dual sided adhesive tape 48 is formed of a transparent film-like material, the normal character image is printed on the printing tape 33. The printing tape 33 and the dual sided adhesive tape 48 are adhered, and the releasable paper 47 is peeled off and affixed, for example, on window glass from the inside. Therefore, the printed image is visible as a normal image from the outside of the window.

When the first tape cassette 31 is assembled in the tape cassette holding portion 14, the first and the second operation projections 23 and 24 provided on the tape cassette holding portion 14 are pressed by the lower side of the cassette case 32.

Next, a second tape cassette 61 will be described with reference to FIG. 6. The second tape cassette 61 differs from the first cassette 31 by not including the printing tape 33, the tape spool 34, the dual sided adhesive tape 48, and the dual sided adhesive tape spool 45. Instead of the above, the second tape cassette 61 has a printing tape 63 and a tape spool 64. The other members which constitute the second tape cassette 61 are the same as the members constituting the first tape cassette 31. Thus, the explanation of these same members is omitted.

As shown in FIG. 6, the right side of the cassette case 32 of the second tape cassette 61 has the rotation shaft 46 with the tape spool 64 of the printing tape 63 wound thereon. The printing tape 63 has one printing surface on which an image is formed by the thermal head 20 and an opposite surface on which an adhesive layer is formed to adhere a releasable paper 65. The printing tape 63 is wound on the tape spool 64 with the releasable paper 65 facing outwardly. The normal character image is printed on the printing surface of the printing tape 63. When the printing tape 63 is formed of a transparent film-like material, the reflected character image is printed on the printing tape 63, and the releasable paper 65 is peeled off and affixed, for example, on the inside of window glass. Therefore, the printed image is visible as a normal image from the outside of the window.

Further, a first detection hole 67 is formed in the left upper part of the cassette case 32 of the second tape cassette 61. The first detection hole 67 is positioned so that the first operation projection 23 is aligned therewith when the second tape cassette 61 is assembled into the tape cartridge holding portion 14. Upon assembly, the operation projection 23 is positioned within the first detection hole 67. Therefore, the lower surface of the second tape cassette 61 does not depress the first operation projection 23 into the interior of the main body 2 of the printing device 1. However, the second operation projection 24 is depressed into the interior of the main body 2 of the printing device 1 by the lower surface of the second tape cassette 61.

A third tape cassette 71 is described with reference to FIG. 7. The third tape cassette 71 is similar to the first tape cassette 31 except that the third tape cassette 71 does not include the printing tape 33, the tape spool 34, the dual sided adhesive tape 48, and the dual sided adhesive tape spool 45. Instead of the above, a base tape 73 and a base tape spool 74 are stored. An ink ribbon 76, which is different from the ink ribbon 37 of the first tape cassette 31, is wound around an ink ribbon spool 77. The other members which constitute the third tape cassette 71 are the same as the members constituting the first tape cassette 31. Therefore, the explanation for these same members is omitted.

As shown in FIG. 7 in the right side of the cassette case 32 of the third tape cassette 71, the rotation shaft 46 is rotatably provided with the base tape spool 74 of the base tape 73 for instant lettering or iron printing. The base tape 73 is wound around the base tape spool 74 with its printing surface facing inside.

Moreover, the surface of the wound ink ribbon 76 facing outward has an ink coating that contains pressure sensitive adhesive or thermo-sensitive adhesive. The thermo-sensitive adhesive layer is formed on the coated ink layer. Upon printing, the thermo-sensitive adhesive layer and the ink layer heated by the thermal head 20 are transferred to the printing surface of the base tape 73 from the ink ribbon 76. When the base tape 73 is pressurized or heated from the non-printing surface of the base tape 73, the ink is transferred to an image transferred material by the pressure sensitive adhesive or thermosensitive adhesive included in the ink. In this case, the reflected character image is printed on the printing surface of the base tape 73.

Further, a second detection hole 79 is formed in the left upper part of the cassette case 32 of the second tape cassette 71. The second detection hole 79 is formed in a different position compared to the first detection hole 67. The second detection hole 79 is positioned so that the second operation projection 24 is aligned therewith when the third tape cassette 71 is assembled to the tape cartridge holding portion 14. Once assembled, the operation projection 24 is positioned within the second detection hole 79. Therefore, the lower surface of the third tape cassette 71 does not depress the operation projection 24 into the interior of the main body 2 of the printing device 1. A second image receiving medium of the present invention is constructed by the base tape 73.

Figure 1:
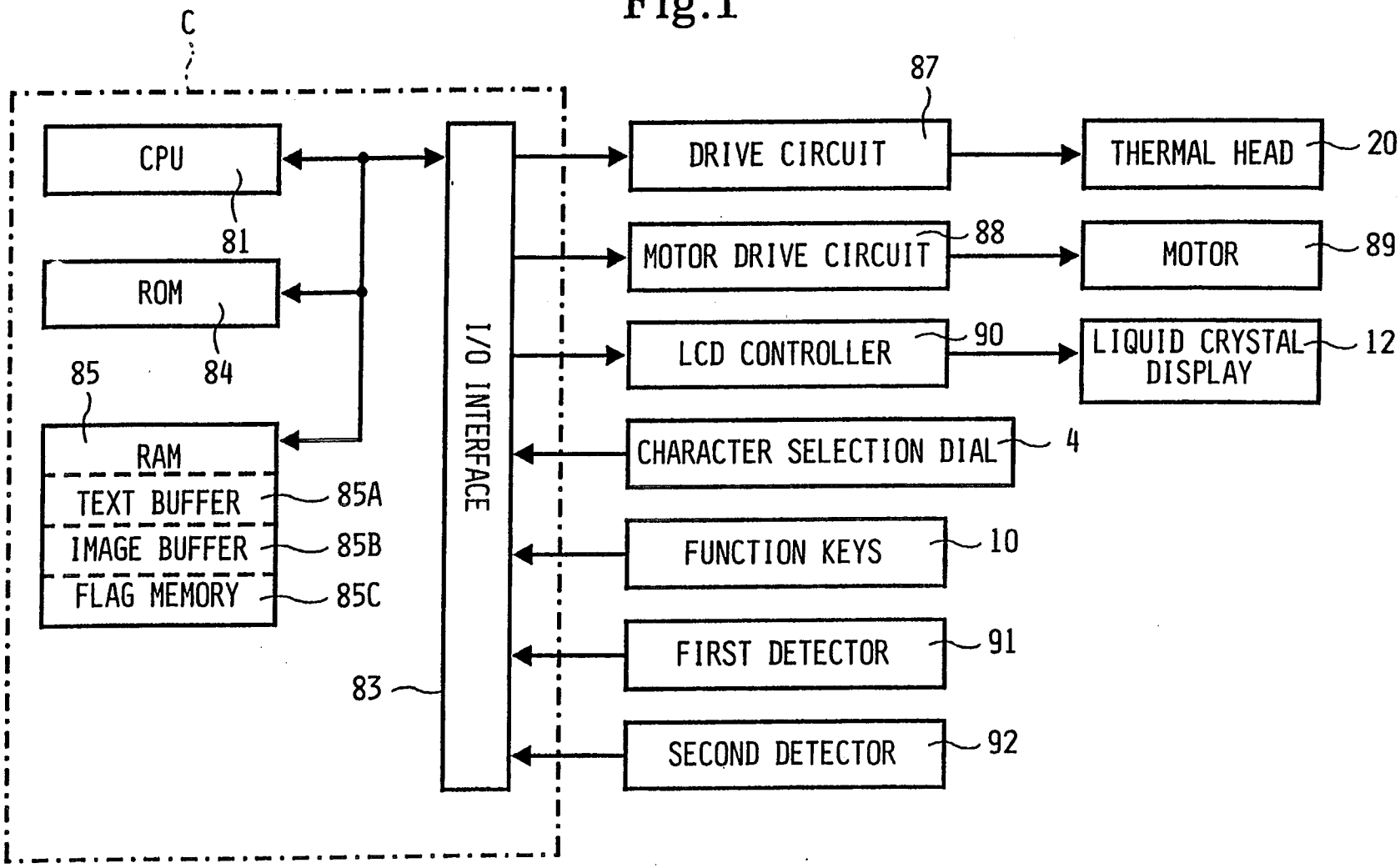
FIG. 1 is a block diagram showing a control circuit of a printing device according to this invention.

Next, the control arrangement of the print device 1 will be described with reference to the block diagram shown in FIG. 1.

According to a control device C, a CPU 81 is provided for overall processing. The CPU 81 is connected to an I/O interface 83, a ROM 84 and a RAM 85 through a bus 82 such as a data bus. The control means of the present invention is constructed by this control device C.

The I/O interface 83 of this control device C connects to a drive circuit 87 for driving the thermal head 20, a motor drive circuit 88 for driving a motor 89 connected to the ribbon take-up cam 16 and the tape feeding roller cam 18, a display controller (LCD controller) 90 having a display ROM for storing dot pattern data being displayed in the LCD 12 and a display RAM for outputting the dot pattern data, a character selection dial 4, plurality of function keys 10, the first detector 91 and the second detector 92.

The ROM 84 stores a display control program that controls the LCD controller 90 for displaying images such as a character and a symbol input by the character selection dial 4 on the LCD 12. The ROM 24 also stores a drive control program that controls the thermal head 20 and the motor 89 by individually reading the data stored in the image buffer 85B described below and a control program that controls a tape making process described below. Further, the ROM 84 stores dot pattern data concerning a plurality of characters provided on the character selection dial 4 corresponding to the character data output from the character selection dial 4. The RAM 85 includes a text buffer 85A, an image buffer 85B, and a flag memory 85C. The text buffer 85A stores character code of the character input by the character selection dial 4. The text buffer 85B stores dot pattern data read from the ROM 84 based on the character code stored in the image buffer 85A. The flag memory 85C stores a print mode flag IM whose value is changed when the print mode change key 7 in the function keys 10 is operated.

Figure 8A:
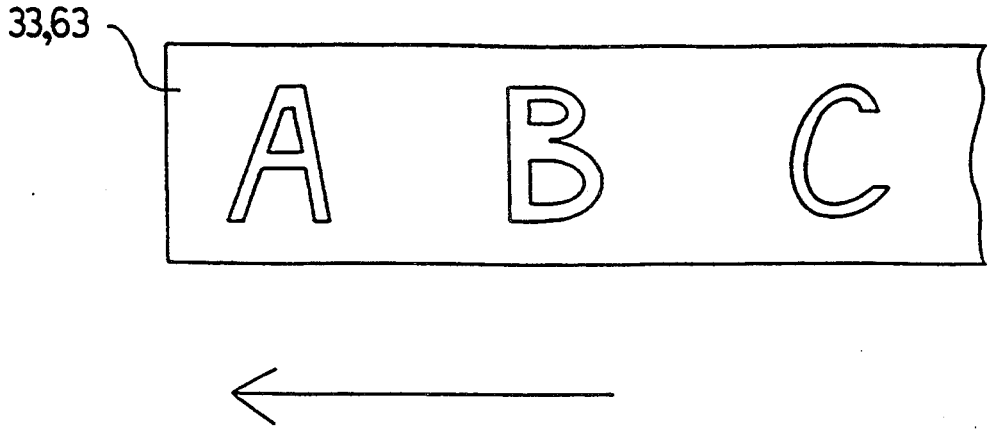
FIG. 8(A) is a plan view of a printed tape viewed from the printing side with a normal character image.
Figure 8B:
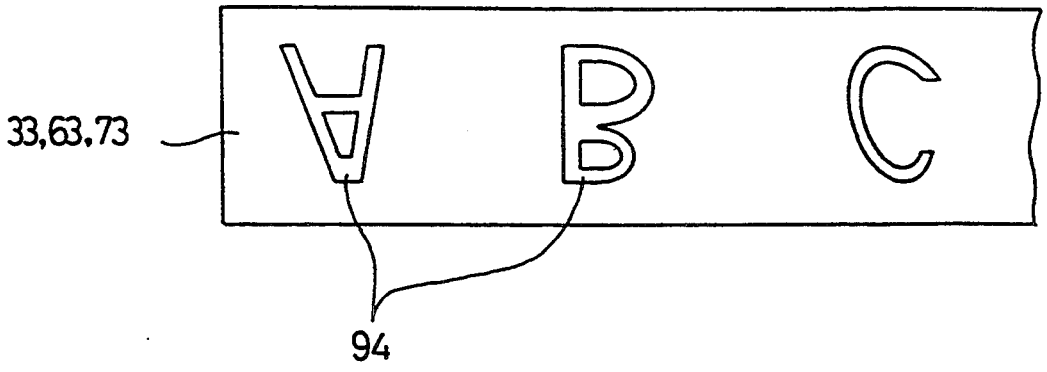
FIG. 8(B) is a plan view of a printed tape viewed from the printing side with a reflected character image.

The value of the print mode flag IM is set as "1" when the normal character image print mode is set by the print mode change key 7. The value of the print mode flag IM is set as "0" when the reflected character image print mode is set by the print mode change key 7. The normal character image print mode is a print mode to print the normal character image on the printing surface of the printing tapes 33 and 63 as shown in FIG. 8(A). The reflected character image print mode is a print mode to print the reflected character image 94 on printing tapes 33 and 63 and the base tape 73 as shown in FIG. 8(B). The reflected image is provided by turning the normal image 180 degrees with respect to a line perpendicular to the tape feeding direction indicated by an arrow in FIG. 8(A). The mode set means of the present invention is constructed by the print mode change key 7 and the print mode flag IM.

The first detector 91 and the second detector 92 are constructed from a micro switch. When the first operation projection 23 and the second operation projection 24 are pressed during the assembly of the tape cassettes 31, 61 and 71 into the tape cassette holding portion 14, the first detector 91 and the second detector 92 detect the existence of the tape cassettes and output a detection signal to the I/O interface 83 of the control device C.

A tape making operation and a printing operation of the printing device 1 thus constructed is explained with reference to the flowcharts shown in FIGS. 9 and 10. In the flowcharts, Si (i=1,2,3 . . . ) refers to each step thereof.

Figure 9:
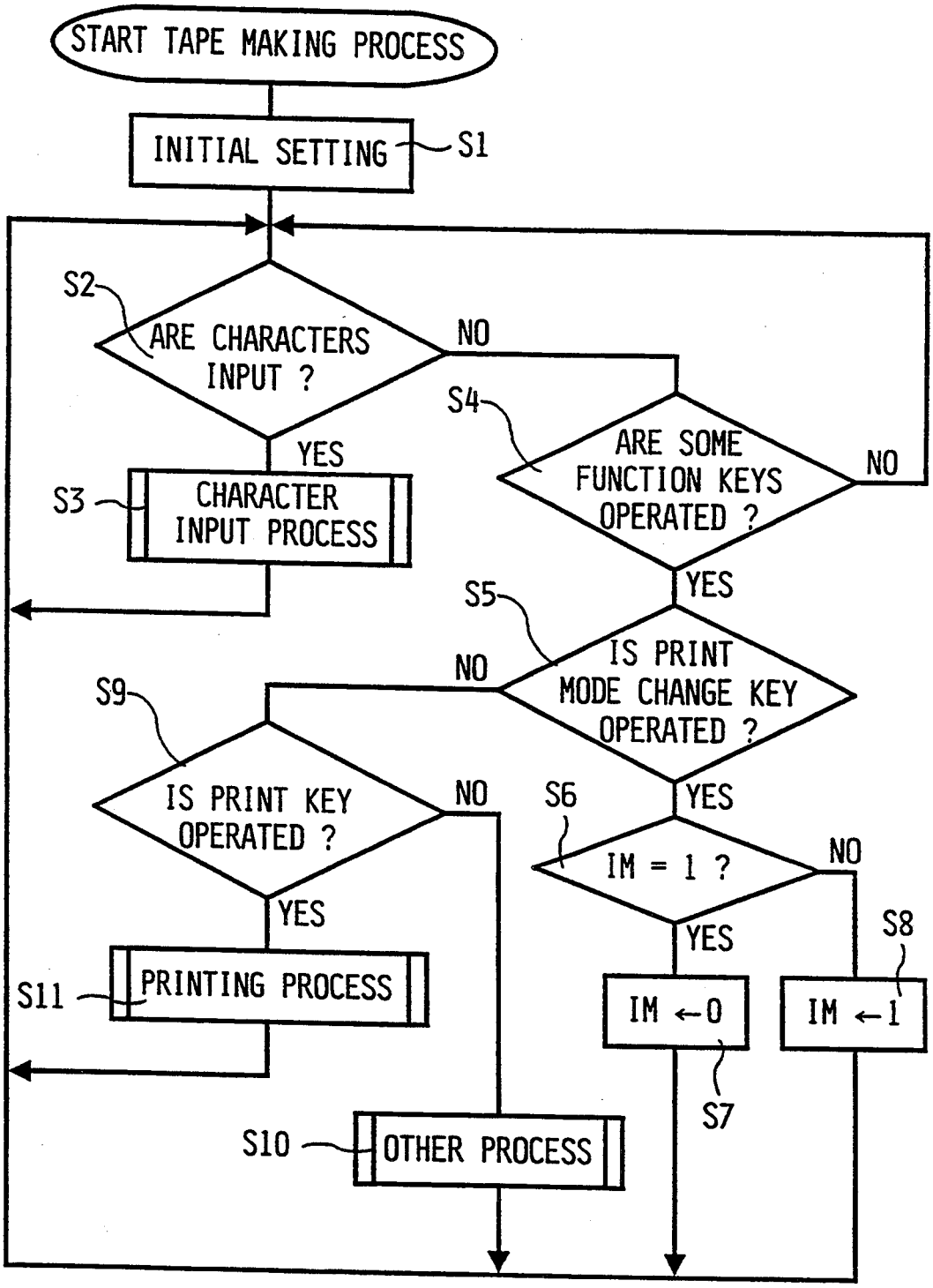
FIG. 9 is a flowchart of a tape making process.
Figure 10:
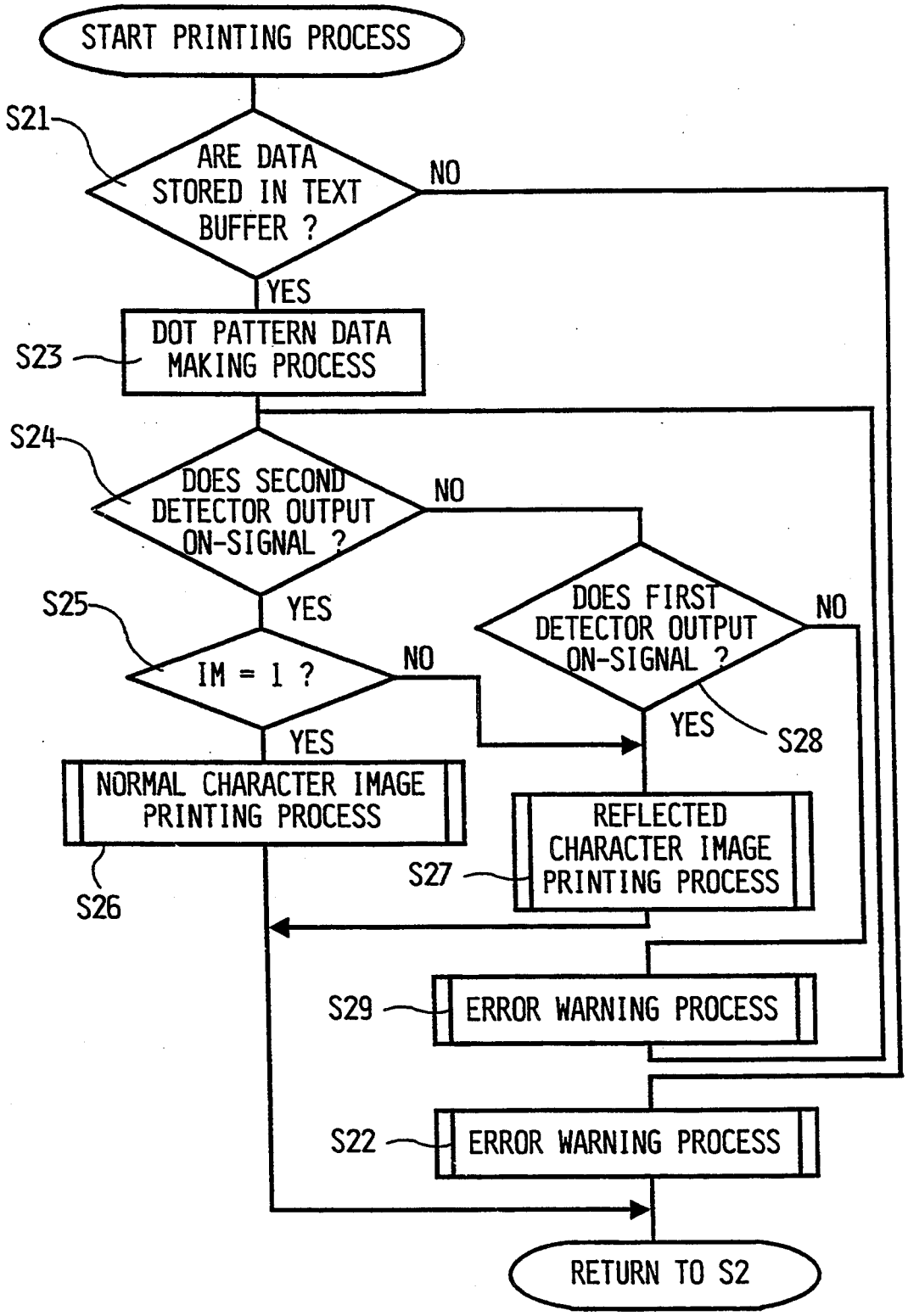
FIG. 10 is a flowchart of a print process.

When the power supply switch 6 of the printing device 1 is operated and the power supply is turned on, a tape making process shown in FIG. 9 is executed by the control device C. At the beginning of tape making process, an initial setting is executed, and the data stored in the text buffer 85A and the image buffer 85B provided in the RAM 85 is cleared (S1). In this initial setting, the value of the print mode flag IM is set as "1", and the print mode is set as the normal character image print mode.

At step S2, it is determined whether or not images such as characters and symbols are input by an operation of the character selection dial 4. When some character are input by the operation of the character selection dial 4 (S2:YES), a character code which shows the input character is memorized in the text buffer 85A at step S3. 0n the other hand, if no characters are input by the operation of the character selection dial 4 (S2:NO), it is determined whether or not a function key is operated at step S4. If no keys are operated (S4:NO), the process returns to step S2.

When the print mode change key 7 is operated (S4,S5:YES), it is determined whether or not the value of the print mode flag IM is "1". In other words, the print mode is set as the normal character image print mode at step S6. If the value of the print mode flag IM is "1", that is, the normal character image print mode is set (S6:YES), the value of the print mode flag IM is set as "0" and the print mode is set as the reflected character image print mode at step S7. If the value of the print mode flag IM is "0", that is, the reflected character image print mode is set (S6:NO), the value of the print mode flag IM is set as "1" and the print mode is set as the normal character image print mode at step S8. When the processing at step S7 or step S8 ends, the process returns to step S2.

When keys other than the print mode change key 7 and the print key 8 are operated (S4:YES and S5,S9:NO) and the processing corresponding to the operated key is executed at step S10, the process then returns to step S2. When the print key 8 is operated (S4:YES, S5:NO, S9:YES), the print processing shown in FIG. 10 is executed at step S11.

At the beginning of the printing process, it is determined whether or not the character code is memorized in the text buffer 85A at step S21. If no character code is memorized in the text buffer 85A (S21:NO), an error warning process for displaying an error message on the liquid crystal display 12 is executed at step S22. The error message shows that the printing process cannot be executed. When this printing process ends, the flow returns to the tape making process shown in FIG. 9, and the step S2 is newly executed.

If the character code is memorized in the text buffer 85A (S21:YES), a dot pattern data making process is executed at step S23. In the dot pattern data making process, the character code is read from the text buffer 85A one by one, and the dot pattern data corresponding to the character code is read from the ROM 84. The dot pattern data read from the ROM 84 is memorized in the image buffer 85B.

When the dot pattern data is made based on the character code memorized in the text buffer 85A, it is determined whether or not the second detector 92 outputs an ON signal at step S24. If the first tape cassette 31 or the second tape cassette 61 is assembled in the tape cassette holding portion 14, the lower surface of the cassette case 32 presses the second operation projection 24. Thereby, the second detector 92 turns on, and the 0N signal is output from the second detector 92.

If it is determined that the second detector 92 outputs an ON signal (S24:YES), then it is determined whether or not the value of the print mode flag IM is "1" at step S25. If the value of the print mode flag IM is "1" (S25:YES), the print mode is set as the normal character image print mode. The dot pattern data memorized in the image buffer 85B is output to the thermal head 20 by each line. Then, the normal character image printing process, which prints the normal character image as shown in FIG. 8(A) on the printing surface of the printing tapes 33 and 63, is executed at step S26. When this printing process is completed, the process returns to the tape making process shown in FIG. 9, and the step S2 is newly executed.

When transparent material is used for the dual sided adhesive tape 48 of the first tape cassette 31, the printing tape 33 on which the normal character image is printed and on which the transparent dual sided adhesive tape 48 is adhered to the printing surface is used by peeling off releasable paper 47. The tape 33 can then be affixed to the inside of a window, for example. Thus, the printed image is visible as a normal image from the outside of the window. Such printing tape 33 can be used as a tape for an advertisement in a store window.

The printing tape 63 of the second tape cassette 61 on which the normal character image is printed can be used as a label tape for files by peeling off the releasable paper 65. The tape 63 can then be affixed to the back cover of a file.

When the first tape cassette 31 or the second tape cassette 61 is assembled in the tape cassette holding portion 14 (S24:YES), and if the value of the print mode flag IM is "0" (S25:NO), the print mode is set as the reflected character image print mode. Therefore, the dot pattern data memorized in the image buffer 85B is output to the thermal head 20 by each line by turning the normal image by 180 degrees. The reflected character image printing process prints the reflected character image as shown in FIG. 8(B) on the printing surface of the printing tapes 33 and 63 in step S27. When this printing process is completed, the process returns to the tape making process shown in FIG. 9, and step S2 is newly executed. The reflected character image is printed on the transparent printing tape 33 of the first tape cassette 31, on which the dual sided adhesive tape 48 is adhered, and is visible as a normal image.

Therefore, this printing tape 33 can be used as a label tape for files and the like. Further, as the printed surface is sandwiched between the printing tape 33 and the dual sided adhesive tape 48, the printed surface is not damaged by external forces.

When transparent material is used for the printing tape 63 of the second tape cassette 61, the above mentioned tape for an advertisement can be made by printing the reflected character image in the reflected character image print mode on the printing surface of the printing tape 63.

On the other hand, if the first tape cassette 31 or the second tape cassette 61 is not assembled in the tape cassette holding portion 14 and the ON signal is not output from the second detector 92 (S24:NO), it is determined whether or not the first detector 91 has output the ON signal at step S28.

If the third tape cassette 71 is assembled in the tape cassette holding portion 14, the first operation projection 23 is depressed by the lower surface of the cassette case 32. However, the operation projection 24 is positioned within the second detection hole 79 and is not depressed by the lower surface of the cassette case 32. Thus, the ON signal is output from the first detector 91 rather than from the second detector 92 (S24:NO, S28:YES). Therefore, the reflected character image print processing is executed to the base tape 73 of the third tape cassette 71 at step S27. That is, when the third tape cassette 71 is assembled in the tape cassette holding portion 14, the print mode becomes the reflected character image print mode without any relation to setting of the print mode change key 7. Then, the reflected character image print processing is executed.

When the reflected character image is thus printed on the printing surface of the base tape 73, the printed ink image is transferred to the image transferred material by rubbing the non-printed surface or heating it with an iron. Thus, the transferred image becomes a normal character image.

On the other hand, if neither tape cassette 31, 61 nor 71 is assembled in the tape cassette holding portion 14, the first and the second operation projections 23 and 24 are not depressed. Therefore, the ON signal is not output from the first detector 91 or the second detector 92 (S24,S28:NO). Accordingly, an error warning process that displays error messages such as "There is no tape cassette" is executed at step S29. Afterwards, the process returns to the step S24 and repeatedly executes steps S24, S28 and S29 until the tape cassette is assembled into the tape printing device 1.

As described above, according to the printing device 1 one of the normal character image and the reflected character image is printed on the printing tape 33 and 63 according to the print mode set by the print mode change key 7 when one of the first tape cassette 31 and the second tape cassette 61 is assembled in tape cassette holding portion 14. When the third tape cassette 71 is assembled in the tape cassette holding portion 14, the print mode selected by the print mode change key 7 is disregarded, and the reflected character image is only printed on the base tape 73. Therefore, making a useless printing tape printed in mistaken print mode is prevented.

It is to be understood that the present invention is not restricted to the particular forms shown in the foregoing embodiment. Various modifications and alterations can be added thereto without departing from the scope and spirit of the invention encompassed by the appended claims.

For example, it is possible to control the printing device 1 to automatically print the normal character image on the printing tape 63 when the second tape cassette 61 with normal printing tape 63 is assembled in the tape cassette holding portion 14. It is also possible to control the printing device 1 to automatically print the reflected character image on the printing tape 63 when the second tape cassette 61 with a printing tape 63 specially formed with transparent material is detected.

What is claimed is:

1. A printing device for selectively printing a normal character image and a reflected character image on a tape, comprising:

a housing having a tape cassette holder for detachably holding interchangeable cassettes;

a first detector in said housing that detects assembly of a first cassette into said housing;

a second detector in said housing that detects assembly of a second cassette into said housing;

a printer in said housing printing one of a normal character print mode and a reflected character print mode;

a print mode setter coupled to said printer setting a print mode of said printer as one of a normal character print mode and a reflected character print mode; and a controller coupled to said first detector, said second detector, said printer and said print mode setter, said controller including an automatic print mode determiner that sets an automatic print mode, wherein said controller controls said printer based on the print mode set by said print mode setter when a first interchangeable cassette is detected by said first detector, and overrides the print mode set by said print mode setter and controls said printer based on the automatic print mode set by said determiner when a second interchangeable cassette is detected by said second detector.

2. The printing device of claim 1, wherein said first detector includes a first actuator protruding from said housing in said tape cassette holder, said first actuator being movable between a biased position to a depressed position into said housing, and a first output coupled to said first actuator outputting a signal based on the position of said first actuator.

3. The printing device of claim 2, wherein said second detector includes a second actuator protruding from said housing in said tape cassette holder, said second actuator being movable between a biased position to a depressed position into said housing, and a second output coupled to said second actuator outputting a signal based on the position of said second actuator.

4. The printing device of claim 1, wherein said housing includes a ribbon take-up cam, a tape feed roller cam, and wherein said printer is a thermal head.

5. The printing device of claim 1, further comprising a memory storing character data and a print mode set by said print mode setter.

6. The printing device of claim 5, further comprising a data warning device coupled to said controller warning when no character data is stored in said memory.

7. The printing device of claim 5, wherein said controller comprises a comparison device comparing the print mode automatically set by said determiner to the print mode set by said print mode setter stored in said memory.

8. The printing device of claim 1, further comprising a cassette warning device coupled to said controller warning when no cassette is detected in said housing.

9. A printing device for a tape printing device having a normal character image print mode and reflected character image print mode, comprising:

housing means for housing a removable tape cassette and a printing means for printing on a tape in a tape cassette;

detecting means for detecting an assembly of one of a first tape cassette and a second tape cassette into said housing means;

print mode setting means coupled to said printing means for setting a print mode as one of a normal character print mode and a reflected character print mode; and control means coupled to said detecting means and said printing means for controlling a print mode of said printing means, said controller comprising an automatic print mode determining means for automatically setting a print mode independent of said print mode setting means, wherein said control means controls said printing means based on the print mode set by said print mode setting means when a first cassette is detected by said detecting means, and overrides the print mode set by said print mode setting means and controls said printing means based on the automatic print mode set by said automatic print mode determining means when a second cassette is detected by said detecting means.

10. The printing device of claim 9, wherein said detecting means comprises a first detector with a first depressible actuator movable between a biased position to a depressed position and a first output coupled to said first actuator outputting a signal based on the position of said first actuator.

11. The printing device of claim 10, wherein said detecting means further comprises a second detector with a second depressible actuator movable between a biased position to a depressed position and a second output coupled to said second actuator outputting a signal based on the position of said second actuator.

12. The printing device of claim 9, wherein said housing means comprises a tape cassette holder, and a take-up cam and a tape feed roller cam coupled to said tape cassette holder.

13. The printing device of claim 9, further comprising input means for inputting character data for printing, including character codes, and memory means for storing input character data, wherein said controller further includes a searching means for searching for character codes in said memory means.

14. The printing device of claim 13, further comprising a data warning means coupled to said control means for warning when said searching means finds no character data stored in said memory means.

15. The printing device of claim 9, wherein said control means comprises comparison means for comparing a print mode automatically set by said automatic print mode determining means to a print mode set by said print mode setting means.

16. The printing device of claim 9, further comprising a cassette warning means coupled to said control means for warning when no cassette is detected in said housing means.

17. A printing assembly for printing an image on an image receiving medium, the assembly comprising:

a housing;

a first cassette holding a first image receiving medium assembled in said housing;

a second cassette holding a second image receiving medium assembled in said housing, said first cassette being interchangeable with said second cassette;

a print mode setter in said housing selectively setting one of a normal character image print mode and a reflected character image print mode;

a detector in said housing that detects assembly of said first cassette and said second cassette in said housing and outputting a signal;

a printer in said housing printing one of a normal character image mode and a reflected character image mode on one of the first image receiving medium and the second image receiving medium; and a controller in said housing coupled to said print mode setter, said detector, and said printer, said controller controlling said printer to print one of a normal character image mode and a reflected character image mode, wherein when said first cassette is detected in said housing said controller prints one of a normal character image mode and a reflected character image mode on the image receiving medium based on a print mode set by said print mode setter, and wherein when said second cassette is detected in said housing said controller prints one of a normal character image mode and a reflected character image mode on the second image receiving medium based on the detected second cassette and overrides the print mode set by said print mode setter.

18. The printing assembly of claim 17, wherein said first image receiving medium and said second image receiving medium are tapes.

19. The printing assembly of claim 17, wherein said detector includes a first movable projection and a second movable projection protruding from said housing and depressible into said housing.

20. The printing assembly of claim 19, wherein said first cassette includes a first detection formation positioned to receive said first projection upon assembly of said first cassette to said housing, and said second cassette includes a second detection formation positioned to receive said second movable projection upon assembly of said second cassette to said housing.

21. The printing assembly of claim 19, wherein said detector further includes a micro-switch coupled to each said first projection and said second projection to output a detection signal based on detecting assembly of said first and second cassette by depressing said first and second projection into said housing.

22. The printing assembly of claim 17, wherein said mode setter includes a print mode flag for setting a normal character image print mode and a reflected character image print mode, said print mode flag being activated when one of said first detector and second detector outputs a detection signal.

23. A method of controlling a print mode in a tape printing device that has a normal character mode and a reflected character mode, comprising the steps of:

storing character data;

converting stored character data to dot pattern data for printing;

inserting a tape cassette into the tape printing device;

setting a print mode from one of a normal character mode and a reflected character mode;

detecting which tape cassette has been inserted into the tape printing device;

controlling the tape printing device to print a print mode based on the inserted tape cassette, including comparing the set print mode to a stored print mode corresponding to the inserted tape cassette; and printing an image in a print mode suitable for the inserted tape cassette based on the dot pattern data.

24. The method of claim 23, further comprising the steps of:

warning when no tape cassette has been inserted; and warning when no character code data has been stored.

25. The method of claim 23, wherein the step of detecting which tape cassette has been inserted includes outputting a first detecting signal for a first tape cassette and outputting a second detecting signal for a second tape cassette.

26. The method of claim 23, wherein the step of controlling the tape printing device includes overriding the set print mode.

* * * * *